US008141694B2

(12) United States Patent
Krallinger

(10) Patent No.: US 8,141,694 B2
(45) Date of Patent: Mar. 27, 2012

(54) APPARATUS FOR THE PRODUCTION AND/OR MACHINING OF PANELS

(75) Inventor: Rupert Krallinger, St. Martin (AT)

(73) Assignee: Interglarion Limited, Nikosia (CY)

( * ) Notice: Subject to any disclaimer, the term of this patent is extended or adjusted under 35 U.S.C. 154(b) by 486 days.

(21) Appl. No.: 12/375,652

(22) PCT Filed: Jul. 30, 2007

(86) PCT No.: PCT/EP2007/006732

§ 371 (c)(1),
(2), (4) Date: Jan. 29, 2009

(87) PCT Pub. No.: WO2008/014963

PCT Pub. Date: Feb. 7, 2008

(65) Prior Publication Data

US 2009/0324371 A1 Dec. 31, 2009

(30) Foreign Application Priority Data

Jul. 31, 2006 (DE) ..... 10 2006 035 648

(51) Int. Cl.
*B27F 1/02* (2006.01)

(52) U.S. Cl. ..... 198/345.1; 198/620; 198/817; 198/867.07; 198/867.08

(58) Field of Classification Search ..... 198/345.1, 198/346, 620, 688.1, 817, 842, 867.07, 867.08
See application file for complete search history.

(56) References Cited

U.S. PATENT DOCUMENTS 1,537,820 A 5/1925 Grunow
3,230,797 A * 1/1966 Murschel ..... 408/89
3,610,500 A * 10/1971 Brown ..... 226/172
4,706,373 A * 11/1987 Andriussi ..... 483/7
5,167,316 A * 12/1992 Kaminski ..... 198/463.4
5,353,910 A * 10/1994 Harris et al. ..... 198/345.1
5,368,643 A * 11/1994 Kuster ..... 118/324
5,370,214 A * 12/1994 Katahira ..... 198/345.1
5,520,276 A * 5/1996 Aoki et al. ..... 198/345.1
5,605,215 A * 2/1997 Gross et al. ..... 198/345.1
5,701,990 A * 12/1997 Novak et al. ..... 198/604
6,231,036 B1 * 5/2001 Johnson et al. ..... 269/56
6,354,430 B1 * 3/2002 Oe ..... 198/626.6
6,398,211 B1 * 6/2002 Schalk ..... 271/182
6,609,861 B2 * 8/2003 Reguzzi ..... 408/35

(Continued)

FOREIGN PATENT DOCUMENTS

DE 198 11 242 9/1999

(Continued)

*Primary Examiner* — Douglas Hess
(74) *Attorney, Agent, or Firm* — Greenblum & Bernstein, P.L.C.

(57) ABSTRACT

A method and apparatus for producing and/or machining panels. The apparatus includes a transport device for transporting a panel along a transport path and a machining device for machining the panel as it moves via the transport device. The transport device includes a plurality of positioning devices arranged one behind the other and spaced apart by a distance along the transport path. Each positioning device includes upper and lower abutment mechanisms arranged opposite one another and on opposite sides of a panel plane, and being spaced apart by a distance. An adjusting device is used for setting the distance between the upper and lower abutment mechanisms. An actuating arrangement is structured and arranged to actuate the adjusting device of at least two of the plurality of positioning devices. An arrangement is used for independently adjusting each of the upper and lower abutment mechanisms of at least one of the plurality of positioning devices.

25 Claims, 3 Drawing Sheets

U.S. PATENT DOCUMENTS

| | | | | |
|---|---|---|---|---|
| 6,688,457 | B2 * | 2/2004 | Haubert et al. | 198/470.1 |
| 6,695,132 | B2 * | 2/2004 | Cook et al. | 198/832.1 |
| 7,044,707 | B2 * | 5/2006 | Garin et al. | 414/749.1 |
| 7,143,676 | B2 * | 12/2006 | Jourdan | 83/412 |
| 7,249,485 | B2 * | 7/2007 | Honda et al. | 72/420 |
| 7,275,897 | B2 * | 10/2007 | Reguzzi | 408/35 |
| 7,392,633 | B2 * | 7/2008 | Heil et al. | 53/250 |
| 7,568,281 | B2 * | 8/2009 | Yoshizawa et al. | 29/740 |
| 7,762,293 | B2 * | 7/2010 | Pervan | 144/82 |

FOREIGN PATENT DOCUMENTS

| | | |
|---|---|---|
| DE | 298 23 760 | 11/1999 |
| DE | 697 06 599 | 7/2002 |
| DE | 20 2004 004 493 | 7/2004 |
| DE | 20 2004 018661 | 2/2005 |
| GB | 28515 | 1/2000 |

* cited by examiner

APPARATUS FOR THE PRODUCTION AND/OR MACHINING OF PANELS

CROSS-REFERENCE TO RELATED APPLICATIONS

The present application is a U.S. National Stage of International Patent Application No. PCT/EP2007/006732 filed Jul. 30, 2007 which published as WO 2008/014963 on Feb. 7, 2008, and claims priority of German Patent Application No. 10 2006 035 648.9 filed Jul. 31, 2006.

BACKGROUND OF THE INVENTION

1. Field of the Invention

The present invention relates to an apparatus for the production and/or machining of panels, comprising a transport device for transporting a panel along a transport device. The transport device has a plurality of positioning devices, which are arranged one behind the other at a distance apart along the transport path and which respectively comprise: an upper and a lower abutment mechanism, which lie opposite one another at a distance apart on both sides of a panel plane, and an adjusting device, with which the distance between the abutment mechanism can be set.

2. Discussion of Background Information

Apparatuses of this type are known in the field of the production or machining of panels and generally comprise an upper and a lower revolving continuous belt, the transporting strands of which are guided in parallel at a distance apart. Between the transporting strands of the continuous belts, panels to be transported are received in frictional engagement and moved on in the transport direction. Along the transport path of the continuous belts, machining devices are usually arranged, which subject the lateral edges of the panels to a machine cutting operation. As machining devices, various types of milling tools in particular can be used here, which on a longitudinal side or a transverse side of the panel form a groove and on the opposite longitudinal side a corresponding tongue. Panels of this type can be joined together in known tongue and groove connection to form, for example, a floor surface of a room.

In order for the panels to be machined with constant quality, it is necessary to ensure a best possible relative positioning between the machining device and the panel to be machined. Thus, particularly where the machining device on the longitudinal side or transverse side of the panel is intended to mill a tongue or a groove, crucial importance is attached to the height position of the tongue or groove beneath the visible surface of the panels, in order to allow a total visible surface of the joined-together panels which is as even as possible. The known apparatuses of the type stated in the introduction therefore comprise said positioning devices having an upper and a lower abutment means and having the adjusting device for setting the distance between the abutment means. Depending on the number of machining devices and the length of the panels to be machined, a correspondingly large number of positioning devices along the transport device is necessary. In order to set the distance between the abutment means in accordance with a specific panel type, all positioning devices of the transport device must be individually adjusted. The traditional panel apparatuses which are used for different panel types with varying plate thickness in the range between about 6 and 12 mm, when the panel type to be machined is changed, thus require a big adjustment effort by the operator, combined with corresponding down times of the apparatus.

SUMMARY OF THE INVENTION

The invention provides an apparatus of the type stated in the introduction, which reduces the adjustment effort, associated with a change of panel type to be machined, on the apparatus, and increases the economy of the apparatus.

The invention also provides an apparatus of the type stated in the introduction, in which the adjusting devices of at least two positioning devices can be actuated simultaneously by way of a common actuating arrangement.

With the measures according to the invention, it is possible, by a single adjusting operation, to simultaneously set a plurality of positioning devices to a desired set distance between their respective abutment mechanism. Where the panel type to be machined is changed to a panel type of larger or smaller plate thickness, the apparatus according to the invention thus allows a marked reduction in the working time needed by an operator for setting the apparatus and a reduction in the downtime of the apparatus which is necessary due to the setting operation. In the final analysis, a more economic overall operation of the apparatus is achieved.

Where in the present description and the associated claims general position terms or phrases such as, say, "top", "bottom", "lateral" or "one behind the other", etc., are used, then these relate to the design and the structure of an apparatus in which the panels are usually transported horizontally, i.e., in such a way that their visible surfaces lie mainly in a horizontal plane. Of course, the subject of the invention also embraces apparatuses in which panels are transported in a different orientation, in which case the above-stated position terms or phrases then relate to the visible surface of the panels to be transported as the imaginary horizontal plane.

In a preferred embodiment of the invention, the actuating arrangement comprises a connecting rod arrangement. Such a connecting rod arrangement offers the possibility of a constructively simple, yet reliable mechanical motional coupling of the adjusting motions of the individual associated positioning devices. Particularly advantageously, it is then possible to interconnect all adjusting devices assigned to the actuating arrangement via a common connecting rod, so that then, for a plurality of positioning devices, only a single connecting rod is necessary. In this case, each of the adjusting devices preferably has a connecting rod coupling for the coupling to the common connecting rod.

In an advantageous refinement of the embodiment using the connecting rod arrangement, it can be provided that the connecting rod is a threaded rod, which, at least in portions assigned to the adjusting devices, has a thread, and that the connecting rod couplings have mating threads, which are in engagement with the threaded rod. Through the use of a threaded rod in interaction with a mating thread of the connecting rod couplings, a rotary adjusting motion of the threaded rod, which can be performed in a simple manner by an operator or an actuator, can be converted into a translatory adjusting motion of the associated adjusting devices. In this case, the step-down effect of the thread engagement, in particular, can be utilized to reduce the amount of effort necessary for the adjustment and to carry out an adjustment of the distance between the abutment mechanism with great precision. The pitch of the used threads can be chosen in accordance with such requirements.

In order also to be able along the transport path of the transport device to bridge a greater distance by the connecting rod arrangement, or to be able to connect a desired number of positioning devices to a common connecting rod in a constructively simple manner, in a further embodiment of the invention it is also proposed that the connecting rod runs substantially parallel to the transport path and that each of the adjusting devices assigned to the actuating arrangement has a motion converting device, which converts the adjusting motion of the connecting rod coupling, which is substantially parallel to the transport path, into an adjusting motion orthogonal to the panel plane in order to displace at least one of the abutment mechanism.

In a further embodiment of the invention, it can be provided that, in at least one of the adjusting devices assigned to the actuating arrangement, each of the two abutment mechanism has an own adjusting mechanism, the two adjusting mechanism being able to be actuated independently of each other. In an apparatus of this design, not only can the distance between the abutment mechanism be tailored to the plate thickness of a specific panel type, but also the absolute height of the panel positioned by the positioning devices, i.e. the vertical position of the panel in relation to the machining device, can be altered per se.

If each of the two abutment mechanism has its own adjusting mechanism, then it can be provided that only one of the two adjusting mechanism can be actuated via the common connecting rod. Thus, the common actuating arrangement can be used, for instance, to adjust the position of the upper abutment mechanism so as to adapt to a desired panel type of specific plate thickness, while the lower abutment mechanism can be set for the less frequently required alteration of the vertical position of the panel individually on each positioning device. Alternatively, however, just the lower adjusting mechanism, can also be adjustable by the common actuating arrangement, or the common actuating arrangement is configured to move both abutment mechanism simultaneously.

In an advantageous refinement, each of the above-stated embodiments can be designed such that at least one of the adjusting devices assigned to the actuating arrangement also has a single-adjustment device, with which the distance between the abutment mechanism of this adjusting device is adjustable independently of the distances between the abutment mechanism of other adjusting devices. In this way, differences between the positioning devices assigned to the common actuating arrangement device, which arise due to production tolerances or due to wear, can be compensated accordingly. In addition, certain differences between the operating characteristics of the respective motion converting devices of the positioning devices and between the individual connecting rod couplings of the positioning devices cannot be precluded, so that said single-adjustment device, in this case also, can be advantageously used for improving the positioning accuracy of the apparatus.

The aforementioned single-adjustment devices can be configured in a constructively simple yet very reliable manner such that at least one of the adjusting devices assigned to the actuating arrangement has a first slide, which is movable substantially orthogonally to the panel plane and is connected to the motion converting device, and a second slide, which is movable substantially orthogonally to the panel plane and to or on which at least one of the abutment mechanism is coupled or formed, a distance between the first slide and the second slide in the direction orthogonal to the panel plane being adjustable by the single-adjustment device.

In a further embodiment of the invention, it is proposed that at least one of the adjusting devices assigned to the actuating arrangement also has a pretensioning device, in particular a spring arrangement, by way of which the upper and/or the lower abutment mechanism can be elastically pretensioned with a specific pretensioning force in the direction of a diminution of the distance between the abutment mechanism, in which case the pretensioning force can then be adjustable by a pretensioning adjusting device of the adjusting device. In this embodiment, a panel to be transported and positioned can be secured with a defined pretensioning force in frictional engagement between the abutment mechanism, the pretensioning force being able to be adapted, where appropriate, to different panel types or to a desired positioning accuracy.

Regarding the technical realization of the above-described embodiments, it is particularly envisaged that the motion converting device and/or, where appropriate, the single-adjustment device and/or, where appropriate, the pretensioning adjusting device comprise(s) a control cam mechanism, in particular a sliding wedge mechanism or a link mechanism. Such control cam mechanisms work particularly reliably and can be designed and produced in a problem-free manner according to the stated requirements with regard to force transmission and motional direction.

The invention also provides for an apparatus for producing and/or machining panels, which comprises a transport device for transporting a panel along a transport path, a machining device for machining the panel as it moves via the transport device, the transport device comprising a plurality of positioning devices arranged one behind the other and spaced apart by a distance along the transport path, each positioning device comprising upper and lower abutment mechanisms arranged opposite one another and on opposite sides of a panel plane, and being spaced apart by a distance and an adjusting device for setting the distance between the upper and lower abutment mechanisms, an actuating arrangement structured and arranged to actuate the adjusting device of at least two of the plurality of positioning devices, and an arrangement for independently adjusting each of the upper and lower abutment mechanisms of at least one of the plurality of positioning devices.

The at least one positioning device having the arrangement for independently adjusting each of the upper and lower abutment mechanisms may be one of coupled to the actuating arrangement and activatable by the actuating arrangement. The arrangement for independently adjusting each of the upper and lower abutment mechanisms may comprise a first device for independently adjusting a position of the upper abutment mechanism and a second device for independently adjusting a position of the lower abutment mechanism. The actuating arrangement may comprise a connecting rod arrangement. The connecting rod arrangement may comprise a threaded rod. Each of the adjusting devices may be one of coupled to the actuating arrangement and activatable by the actuating arrangement.

The apparatus may further comprise a coupling connecting each of the adjusting devices to the actuating arrangement. Each of the plurality of positioning devices may be one of coupled to the actuating arrangement and activatable by the actuating arrangement.

The actuating arrangement may be coupled to at least two of the adjusting devices of the plurality of positioning devices via a common connecting rod. The actuating arrangement may be coupled to each of the adjusting devices of the plurality of positioning devices via a common connecting rod. The actuating arrangement may be coupled to at least two of the adjusting devices of the plurality of positioning devices via a threaded connecting rod and threaded couplings.

The actuating arrangement may run substantially parallel to the transport path. The apparatus may further comprise at least one motion converting device adapted to cause at least one of the upper and lower abutment mechanisms to move orthogonal to the panel plane upon actuation of the actuating arrangement.

One of each of the plurality of positioning devices further comprises at least one motion converting device adapted to cause at least one of the upper and lower abutment mechanisms to move orthogonal to the panel plane upon actuation of the actuating arrangement and each of the plurality of positioning devices further comprises an arrangement adapted to cause at least one of the upper and lower abutment mechanisms to move orthogonal to the panel plane upon actuation of the actuating arrangement.

The apparatus may further comprises one of a single-adjustment device adapted to adjust a distance between at least one of the upper and lower abutment mechanisms and the adjusting device, wherein the distance is adjustable independently of the distance between another of the at least one of the upper and lower abutment mechanisms and another adjusting device and an arrangement adapted to adjust a distance between at least one of the upper and lower abutment mechanisms and the adjusting device of one of the plurality of positioning devices, wherein the distance is adjustable independently of the distance between at least one of the upper and lower abutment mechanisms and the adjusting device of another of the plurality of positioning devices and a first slide movable substantially orthogonally to the panel plane, a second slide movable substantially orthogonally to the panel plane and coupled to at least one of the upper and lower abutment mechanisms, and at least one motion converting device connected to the first slide and being adapted to cause at least one of the upper and lower abutment mechanisms to move orthogonal to the panel plane upon actuation of the actuating arrangement, and a first slide movable substantially orthogonally to the panel plane, at least one motion converting device connected to the first slide and being adapted to cause at least one of the upper and lower abutment mechanisms to move orthogonal to the panel plane upon actuation of the actuating arrangement, a second slide movable substantially orthogonally to the panel plane, and a single-adjustment device coupled to the second slide and being adapted to adjust a distance between at least one of the upper and lower abutment mechanisms and the adjusting device, wherein the distance is adjustable.

The apparatus may further comprise at least one pretensioning device adapted to elastically pretension at least one of the upper and lower abutment mechanisms, whereby one of the upper and lower abutment mechanisms is biased towards another of the upper and lower abutment mechanisms. A biasing force may be adjustable via a pretensioning adjusting device. The apparatus may further comprise a control cam mechanism arranged on at least one of at least one motion converting device, a single-adjustment device, and a pretensioning adjusting device. The control cam mechanism may be one of a sliding wedge mechanism and a link mechanism.

The invention also provides for an apparatus for producing and/or machining panels, comprising a transport device for transporting a panel along a transport path, a machining device for machining the panel as it moves via the transport device, the transport device comprising a plurality of positioning devices arranged one behind the other and spaced apart by a distance along the transport path, each positioning device comprising upper and lower abutment mechanisms arranged opposite one another and on opposite sides of a panel plane, and being spaced apart by a distance and an adjusting device for setting the distance between the upper and lower abutment mechanisms, an actuating arrangement structured and arranged to actuate each of the adjusting devices of the plurality of positioning devices, and an arrangement for independently adjusting the upper and lower abutment mechanisms of each of the plurality of positioning devices.

The invention also provides for a method of using an apparatus for producing and/or machining panels, comprising transporting via a transport device a panel along a transport path, wherein the transport device comprises a plurality of positioning devices arranged one behind the other and spaced apart by a distance along a transport path, machining the panel via a machining device as it moves via the transport device, setting a distance via an adjusting device between upper and lower abutment mechanism of at least one the plurality of positioning devices, wherein the upper and lower abutment mechanisms are arranged opposite one another and on opposite sides of a panel plane, and are spaced apart by the distance, actuating via an actuating arrangement each of the adjusting devices of the plurality of positioning devices, and independently adjusting the upper and lower abutment mechanisms of each of the plurality of positioning devices.

BRIEF DESCRIPTION OF THE DRAWINGS

The present invention is explained in greater detail below with reference to a preferred embodiment, with reference to the appended drawings.

DETAILED DESCRIPTION OF THE INVENTION

Figure 1:
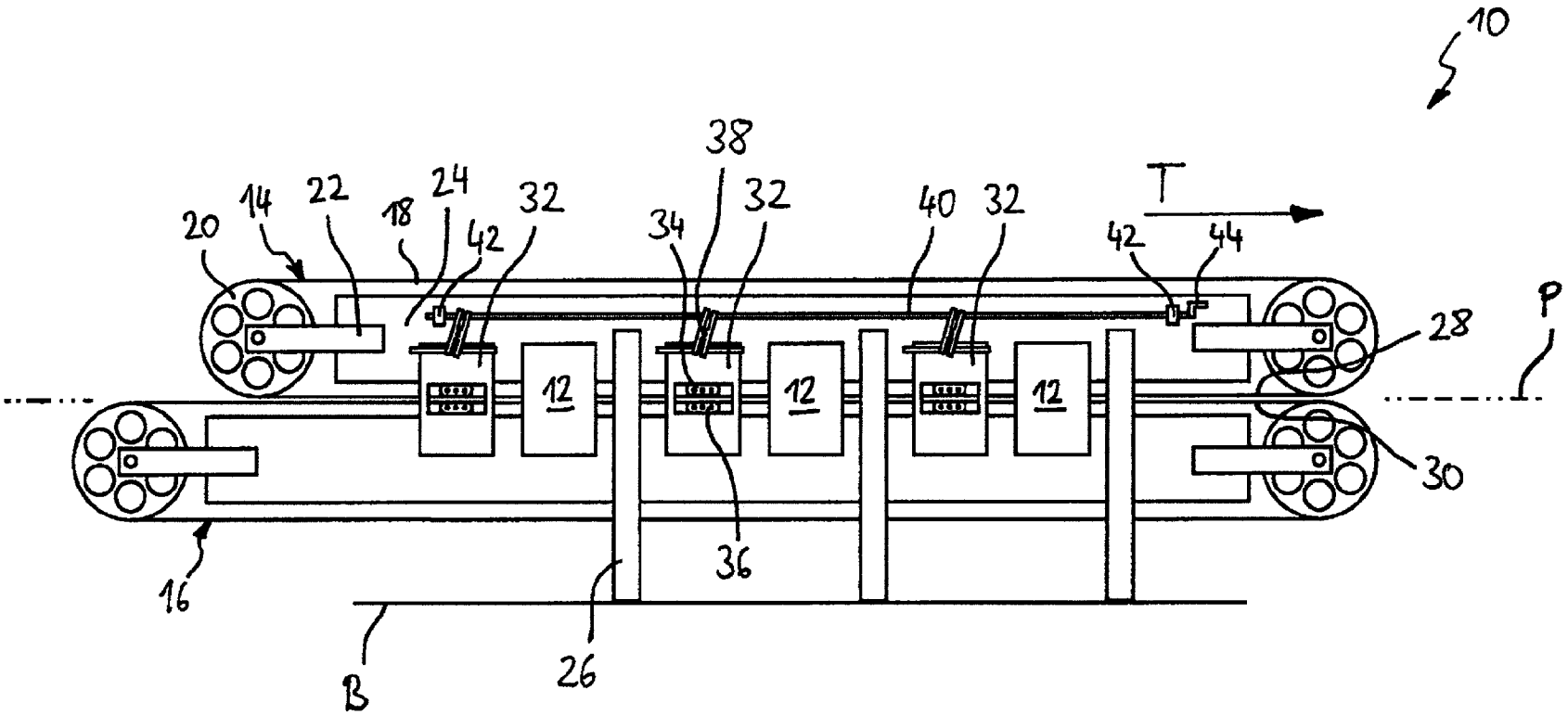
FIG. 1 is a basic representation of an inventive apparatus according to a first embodiment, in side view.

In FIG. 1, an apparatus for the machining of panels is illustrated in general terms by 10. As machining devices, the apparatus 10 comprises three milling tools 12, which, in FIG. 1, are shown purely schematically as rectangles. By way of the milling tools 12, the panels are intended to be machined such that on their one longitudinal side a groove and on their opposite longitudinal side a tongue, corresponding to the geometry of the groove, is formed.

In order to feed the panels to be machined to the milling tools 12, the apparatus 10 has a transport apparatus having an upper conveyor belt 14 and a lower conveyor belt 16. Both conveyor belts 14 and 16 respectively have a continuous belt 18, which respectively revolve around deflection pulleys 20 disposed at the ends of the conveyor belts 14 and 16. Via mountings 22, the deflection pulleys 20 are each attached rotatably to a frame 24, the two frames 24 of the upper and the lower conveyor belt 14 and 16 being fastened to a common support structure 26, which supports the apparatus 10 fixedly on the ground B.

As a result of the support structure 26, the two conveyor belts 14 and 16 are held in a fixed relative position to one another, in which they run substantially parallel to each other, to be precise such that a conveyor strand 28 formed by a lower strand 28 of the upper conveyor belt 14 bears against a conveyor strand 30 formed by an upper strand 30 of the lower conveyor belt 16, or has from this latter conveyor strand a uniform distance roughly corresponding to the plate thickness of a panel, or less.

The upper conveyor belt 14 and the lower conveyor belt 16 thus lie opposite one another on both sides of a horizontal panel plane P and can thus receive a panel between the conveyor strand 28 of the upper conveyor belt 14 and the conveyor strand 30 of the lower conveyor belt 16 and transport it in a transport direction T, the panel remaining aligned substantially in the panel plane P throughout its entire transport through the apparatus 10.

Although a certain positioning of the transported panels already takes place as a result of the above-described reception of the panels between the upper conveyor belt 14 and the lower conveyor belt 16, for the machining of the panels at the milling tools 12 a more accurate positioning of the panels, particularly in the vertical direction, is still necessary. In the embodiment shown in FIG. 1, this vertical positioning is taken care of by three positioning devices 32 arranged one behind the other along the transport direction T, which in FIG. 1 are likewise represented purely schematically. The positioning devices 32 each have an upper abutment mechanism 34 and a lower abutment mechanism 36, which are arranged at a distance apart in order to receive a panel between them.

In order to be able to use the apparatus 10 for use with panel types of different plate thickness, the distance between the upper and lower abutment mechanisms 34, 36 is adjustable via an adjusting device 38, which in FIG. 1 is likewise only indicated.

Above the positioning devices 32, a threaded rod 40 runs parallel to the transport direction T and extends over the regions of all positioning devices 32 along a large part of the length of the upper conveyor belt 14. At its ends, the threaded rod 40 is respectively mounted in a rotatable, yet axially non-displaceable manner, in bearing portions 42 fastened to the frame 24 of the upper conveyor belt 14. The threaded rod 40 is also acted upon by an actuating device 44 for the rotary actuation of the threaded shaft 40, which in FIG. 1 is illustrated schematically by a crank 44 attached to one end of the threaded rod 14.

As can be seen in FIG. 1, the adjusting devices 38 of all three positioning devices 32 are each motionally coupled to the threaded rod 40, so that a rotary motion of the threaded rod 40 is converted by the actuating device 44 in each of the positioning devices 32 into an adjusting motion of the adjusting devices 38, which adjusting motion will be described below.

Figure 2:
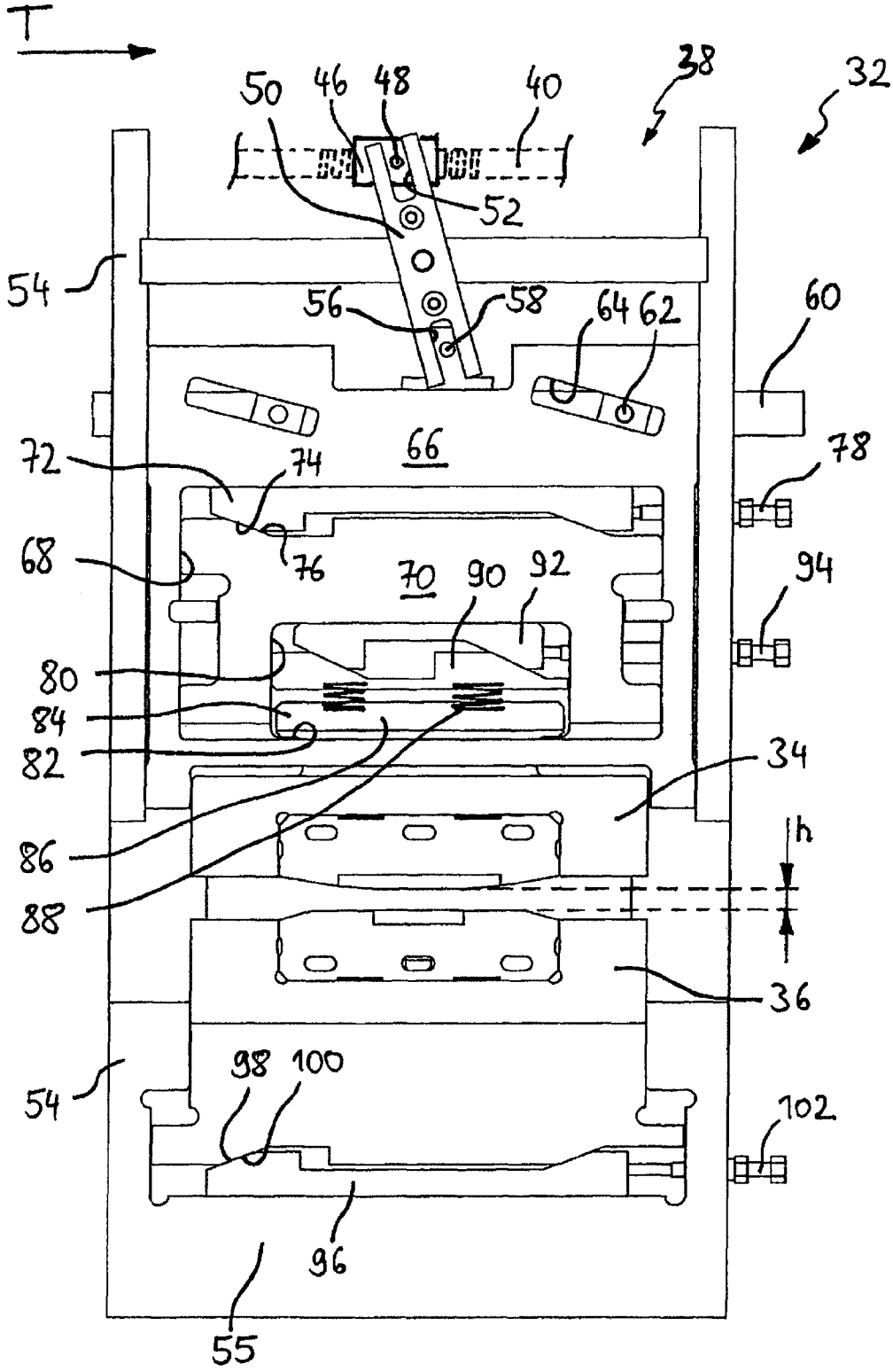
FIG. 2 shows a front view of a positioning device of the transport device shown in FIG. 1.
Figure 4:
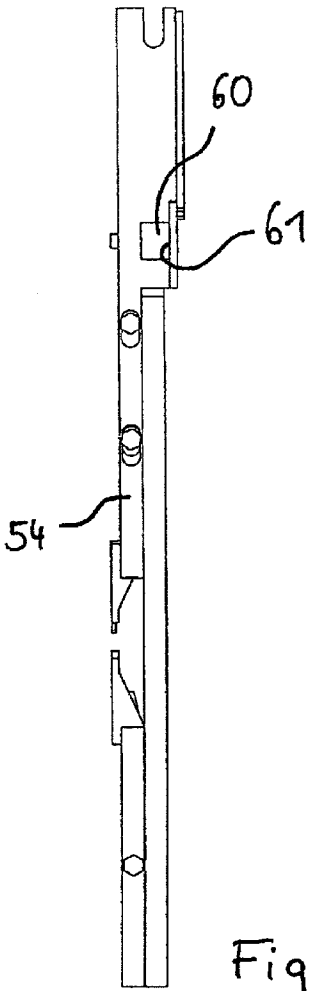
FIG. 4 shows a side view of the positioning device represented in FIG. 2.
Figure 3:
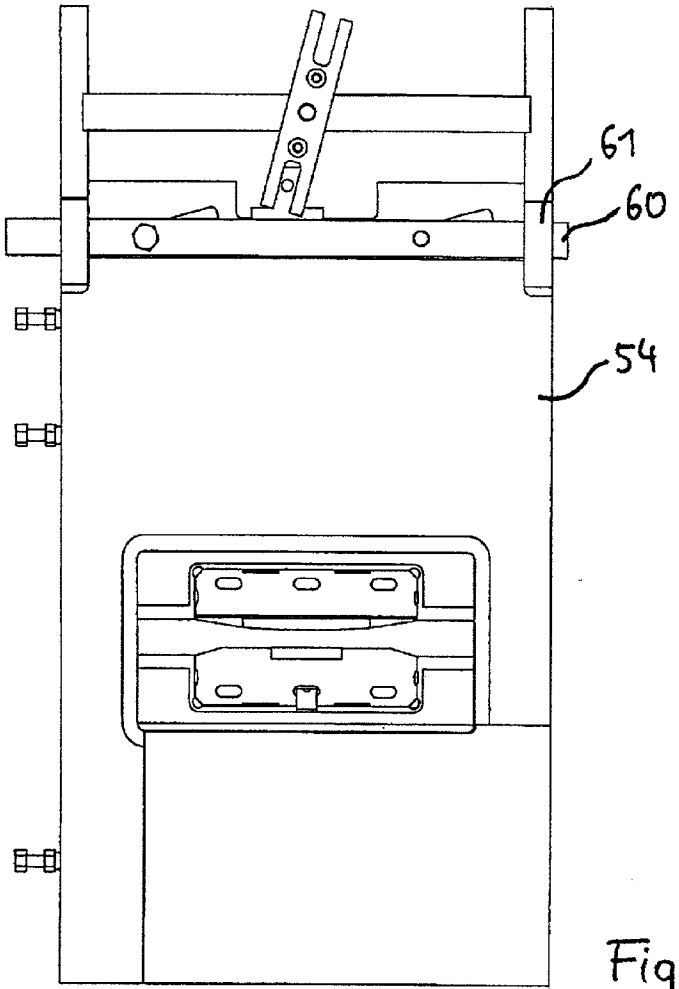
FIG. 3 shows a rear view of the positioning device represented in FIG. 2.

FIGS. 2, 3 and 4 show detailed views of one of the three positioning devices 32. A segment of the threaded rod 40 is indicated with dashed lines, the rotary motion of which is converted into an adjusting motion of the adjusting device 38 for altering a distance "h" between the upper abutment mechanism 34 and the lower abutment mechanism 36. In the embodiment shown, the adjusting device 38 converts the rotary motion of the threaded rod 40 into a vertical displacement motion of the upper abutment mechanism 34.

To this end, the threaded rod 40 has mounted on it a threaded block 46, which has an internal thread corresponding to the external thread of the threaded rod 40, so that, upon a rotation of the threaded rod 40 mounted non-displaceably in the axial direction, it realizes a displacement in the transport direction T or in a direction opposite thereto.

A pin 48 of the threaded block 46 is inserted displaceably into an elongated recess 52 of a rocker 50, which is mounted rotatably on a fixed frame 54 of the positioning device 32. The rocker 50 has at its opposite end a second elongated recess 56, in which a pin 58 of a slide bar 60 is inserted. The slide bar 60 is mounted on the frame 54 on two displacement bearings 61 such that it can only move to and fro parallel to the transport direction T.

Configured on or fastened to the slide bar 60 are two further pins 62, which engage in slots 64, inclined relative to the horizontal plane, of a first slide 66. The first slide 66 is guided on the frame 54 such that it can be displaced only upward or downward in the vertical direction. Upon a displacement of the slide bar 60 parallel to the transport direction T, the pins 62 of the slide bar 60 accordingly run along the oblique slots 64 and thus displace the first slide 66 in the vertical direction.

In a recess 68 of the first slide 66 in the lower region of the first slide 66, a second slide 70 is guided in a vertically displaceable manner. A distance between the first slide 66 and the second slide 70 in the vertical direction is fixed by an adjusting wedge 72, which is disposed in the vertical direction between the first and the second slide 66 and 70. The adjusting wedge 72 has on its bottom side wedge surfaces 74, which run obliquely to the horizontal plane and bear against corresponding wedge surfaces 76 on the top side of the second slide 70. An adjusting screw 78 mounted on the frame 54 moves the adjusting wedge 72 to or fro parallel to the transport direction T, so that the wedge surfaces 74, 76 slide one against the other, whereby the distance between the first slide 66 and the second slide 70 is adjusted.

Similarly to the first slide 66, the second slide 70 also has a recess 80 in its lower region, the recess 80 having at its lower end an inwardly projecting flange 82. Against this inner flange 82 can rest an outer flange 84 of an approximately T-shaped coupling portion 86, which is integrally connected to the upper abutment mechanism 34. A contact between the outer flange 84 of the coupling portion 86 and the inner flange 82 of the second slide 70 defines a maximum distance between the second slide 70 and the upper abutment mechanism 34 held in a vertically displaceable manner thereon.

The vertical displacement of the coupling portion 86 of the upper abutment mechanism 34 in the second slide 70 is subject to a pretensioning by a tensioning device 88, which in FIG. 2 is symbolized by two springs 88. The tensioning device 88 is supported, on the one hand, against the coupling portion 86 and, on the other hand, against a third slide 90 and pretensions the coupling portion 86 in the direction of a contact between the outer flange 84 of the coupling portion 86 and the inner flange 82 of the second slide 70.

The third slide 90 is likewise guided in a vertically displaceable manner in the recess 80 of the second slide bar 70 so as to be able to alter the pretensioning of the tensioning device 88. For this pretensioning adjusting motion, between the third slide 90 and the second slide 70 there is arranged a pretensioning adjusting wedge 92, which, similarly to the working principle of the above-described adjusting wedge 72, is displaceable parallel to the transport direction T and, by way of oblique wedge surfaces, sliding one against the other, on the top side of the third slide 90 and the bottom side of the pretensioning adjusting wedge 92, makes the vertical distance between the second slide 70 and the third slide 90 adjustable.

The motion of the pretensioning adjusting wedge 92 which is necessary for the pretensioning adjustment is effected with the use of a pretensioning setscrew 94 mounted on the frame 54.

In addition to the adjustment of the height or pretensioning force of the upper abutment mechanism, the positioning device shown in FIG. 2 additionally offers the possibility of adjusting the vertical position of the lower abutment mechanism 36 and of thereby adjusting the absolute vertical position of a panel positioned in the positioning device 32. For this purpose, the lower abutment mechanism 36 is guided in a vertically displaceable manner on the frame 54, a vertical distance between the second abutment mechanism 36 and a lower portion 55 of the frame 54 being determined by an adjusting wedge 96. The adjusting wedge 96 is disposed between the lower abutment mechanism 36 and the lower portion 55 of the frame 54 and has on its top side wedge surfaces 98, which run obliquely to the horizontal plane and bear against corresponding oblique wedge surfaces 100 on the bottom side of the lower abutment mechanism 36. Upon a displacement of the adjusting wedge 96 by a setscrew 102 in a direction parallel to the transport direction T, the wedge surfaces 98, 100 slide one against the other and correspondingly displace the lower abutment mechanism 36 in the vertical direction.

The working method of the apparatus 10 is discussed briefly below. In order to prepare the apparatus 10 for the machining of panels of a specific plate thickness, the actuating device 44 is started up and rotates the threaded rod 40 by a specific amount. As an example, the hypothesis is adopted that the apparatus 10 is due to be adjusted from the machining of a thicker panel type to the machining of a thinner panel type. In dependence on the pitch of the thread of the threaded rod 40, the threaded rod 40 is then rotated such that the threaded block 46 shifts a specific distance to the right in FIG. 2. The rightward motion of the threaded block 46 is converted by the rocker 50 into a leftward displacement of the slide bar 60, and the resultant leftward displacement of the pins 62 causes a downward motion of the slots 64 and thus of the first slide 66. This downward motion of the slide 66 is then transmitted via the second slide 70, the third slide 90, the tensioning device 88 and the coupling portion 86 finally to the upper abutment mechanism 34, which is then likewise displaced downward by the desired amount.

It is here assumed that the upper abutment mechanism 34 is in the unloaded state, i.e. there is no panel inserted between the abutment mechanism 34, 36, so that the tensioning device 88 holds the outer flange 84 of the coupling portion 86 in contact with the inner flange 82 of the second slide 70. The distance "h" between the upper and lower abutment mechanisms 34, 36, which is thereby adjusted in the unloaded state, is in practice set slightly smaller than the plate thickness of the panels to be positioned, so that the tensioning device 88 can generate a predetermined contact pressure with which the upper abutment mechanism 34 is pressed against the panel.

In the manner described, the adjusting devices 38 of all positioning devices 32 of the apparatus 10 can be simultaneously adjusted, by rotation of the common threaded rod 40, to a new panel type of smaller plate thickness. The correspondingly reverse adjustment by rotation of the threaded rod 40 in the opposite direction can be realized if the apparatus 10 is due to be prepared for the machining of thicker panels.

If, between the individual positioning devices 32, variances in the respective distance "h" should arise as a result of production tolerances, temperature differences, wear or the like, each of the adjusting devices can also from time to time be individually readjusted by the adjusting screw 78 in the manner described. Similarly, for each positioning device 32, the pretensioning force of the tensioning device 88 can be tuned by adjustment of the pretensioning setscrew 94, for example to particular requirements of the machining device 12 disposed in this region.

The facility to adjust the pretensioning of the tensioning device 88 also offers the advantage that, in the event of wear to the continuous belt 18 of the upper conveyor belt 14, the positioning device 32 can be adapted to this wear by adjustment of the pretensioning force, without an ensuing adjustment of the first slide 66 or second slide 70, and thus an adjustment of the distance "h" between the upper and lower abutment mechanisms 34, 36 in the unloaded state. The drawback which arises in traditional apparatuses, namely that, if the apparatus is adapted to the wear on the upper belt, the setting of the distance "h" also changes, resulting in a change of pressure exerted upon the material by the upper abutment mechanism 34, which in these apparatuses of the prior art can lead to scratching or damaging of the panels, can thus be avoided.

The invention claimed is:

1. An apparatus for producing and/or machining panels, comprising:

a transport device for transporting a panel along a transport path;

a machining device for machining the panel as it moves via the transport device;

the transport device comprising a plurality of positioning devices arranged one behind the other and spaced apart by a distance along the transport path;

each positioning device comprising:

upper and lower abutment mechanisms arranged opposite one another and on opposite sides of a panel plane, and being spaced apart by a distance;

an adjusting device for setting the distance between the upper and lower abutment mechanisms;

an actuating arrangement structured and arranged to actuate the adjusting device of at least two of the plurality of positioning devices; and an arrangement for independently adjusting each of the upper and lower abutment mechanisms of at least one of the plurality of positioning devices.

2. The apparatus of claim 1, wherein the at least one positioning device having the arrangement for independently adjusting each of the upper and lower abutment mechanisms is one of coupled to the actuating arrangement and activatable by the actuating arrangement.

3. The apparatus of claim 1, wherein the arrangement for independently adjusting each of the upper and lower abutment mechanisms comprises a first device for independently adjusting a position of the upper abutment mechanism and a second device for independently adjusting a position of the lower abutment mechanism.

4. The apparatus of claim 1, wherein the actuating arrangement comprises a connecting rod arrangement.

5. The apparatus of claim 4, wherein the connecting rod arrangement comprises a threaded rod.

6. The apparatus of claim 1, wherein each of the adjusting devices are one of coupled to the actuating arrangement and activatable by the actuating arrangement.

7. The apparatus of claim 6, further comprising a coupling connecting each of the adjusting devices to the actuating arrangement.

8. The apparatus of claim 6, wherein each of the plurality of positioning devices are one of coupled to the actuating arrangement and activatable by the actuating arrangement.

9. The apparatus of claim 1, wherein the actuating arrangement is coupled to at least two of the adjusting devices of the plurality of positioning devices via a common connecting rod.

10. The apparatus of claim 1, wherein the actuating arrangement is coupled to each of the adjusting devices of the plurality of positioning devices via a common connecting rod.

11. The apparatus of claim 1, wherein the actuating arrangement is coupled to at least two of the adjusting devices of the plurality of positioning devices via a threaded connecting rod and threaded couplings.

12. The apparatus of claim 1, wherein the actuating arrangement runs substantially parallel to the transport path.

13. The apparatus of claim 1, further comprising at least one motion converting device adapted to cause at least one of the upper and lower abutment mechanisms to move orthogonal to the panel plane upon actuation of the actuating arrangement.

14. The apparatus of claim 1, wherein one of:

each of the plurality of positioning devices further comprises at least one motion converting device adapted to cause at least one of the upper and lower abutment mechanisms to move orthogonal to the panel plane upon actuation of the actuating arrangement; and each of the plurality of positioning devices further comprises an arrangement adapted to cause at least one of the upper and lower abutment mechanisms to move orthogonal to the panel plane upon actuation of the actuating arrangement.

15. The apparatus of claim 1, further comprising one of:

a single-adjustment device adapted to adjust a distance between at least one of the upper and lower abutment mechanisms and the adjusting device, wherein the distance is adjustable independently of the distance between another of the at least one of the upper and lower abutment mechanisms and another adjusting device and an arrangement adapted to adjust a distance between at least one of the upper and lower abutment mechanisms and the adjusting device of one of the plurality of positioning devices, wherein the distance is adjustable independently of the distance between at least one of the upper and lower abutment mechanisms and the adjusting device of another of the plurality of positioning devices; and a first slide movable substantially orthogonally to the panel plane, a second slide movable substantially orthogonally to the panel plane and coupled to at least one of the upper and lower abutment mechanisms, and at least one motion converting device connected to the first slide and being adapted to cause at least one of the upper and lower abutment mechanisms to move orthogonal to the panel plane upon actuation of the actuating arrangement; and a first slide movable substantially orthogonally to the panel plane, at least one motion converting device connected to the first slide and being adapted to cause at least one of the upper and lower abutment mechanisms to move orthogonal to the panel plane upon actuation of the actuating arrangement, a second slide movable substantially orthogonally to the panel plane, and a single-adjustment device coupled to the second slide and being adapted to adjust a distance between at least one of the upper and lower abutment mechanisms and the adjusting device, wherein the distance is adjustable.

16. The apparatus of claim 1, further comprising at least one pretensioning device adapted to elastically pretension at least one of the upper and lower abutment mechanisms, whereby one of the upper and lower abutment mechanisms is biased towards another of the upper and lower abutment mechanisms.

17. The apparatus of claim 16, wherein a biasing force is adjustable via a pretensioning adjusting device.

18. The apparatus of claim 1, further comprising a control cam mechanism arranged on at least one of:

at least one motion converting device;

a single-adjustment device; and a pretensioning adjusting device.

19. The apparatus of claim 18, wherein the control cam mechanism is one of a sliding wedge mechanism and a link mechanism.

20. The apparatus of claim 1, wherein lateral edges of the panel are machined by the machining device.

21. The apparatus of claim 1, wherein the machining device forms a groove on a longitudinal side of the panel.

22. The apparatus of claim 1, wherein the machining device forms a tongue on a longitudinal side of the panel.

23. The apparatus of claim 1, wherein the machining device is a milling tool.

24. An apparatus for producing and/or machining panels, comprising:

a transport device for transporting a panel along a transport path;

a machining device for machining the panel as it moves via the transport device;

the transport device comprising a plurality of positioning devices arranged one behind the other and spaced apart by a distance along the transport path;

each positioning device comprising:

upper and lower abutment mechanisms arranged opposite one another and on opposite sides of a panel plane, and being spaced apart by a distance;

an adjusting device for setting the distance between the upper and lower abutment mechanisms;

an actuating arrangement structured and arranged to actuate each of the adjusting devices of the plurality of positioning devices; and an arrangement for independently adjusting the upper and lower abutment mechanisms of each of the plurality of positioning devices.

25. A method of using an apparatus for producing and/or machining panels, comprising:

transporting via a transport device a panel along a transport path, wherein the transport device comprises a plurality of positioning devices arranged one behind the other and spaced apart by a distance along a transport path;

machining the panel via a machining device as it moves via the transport device;

setting a distance via an adjusting device between upper and lower abutment mechanism of at least one the plurality of positioning devices, wherein the upper and lower abutment mechanisms are arranged opposite one another and on opposite sides of a panel plane, and are spaced apart by the distance;

actuating via an actuating arrangement each of the adjusting devices of the plurality of positioning devices; and independently adjusting the upper and lower abutment mechanisms of each of the plurality of positioning devices.

* * * * *